US007614984B1

(12) United States Patent
Krull

(10) Patent No.: US 7,614,984 B1
(45) Date of Patent: Nov. 10, 2009

(54) EXERCISE METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 0 days.

(21) Appl. No.: 11/522,188

(22) Filed: Sep. 14, 2006

Related U.S. Application Data

(60) Provisional application No. 60/717,489, filed on Sep. 14, 2005.

(51) Int. Cl.
*A63B 21/00* (2006.01)
*A63B 26/00* (2006.01)
*A63B 71/00* (2006.01)

(52) U.S. Cl. ..... 482/131; 482/140; 482/907

(58) Field of Classification Search ..... 482/44, 482/66, 62, 140, 120, 80, 115, 114, 125, 482/137, 907, 60, 910, 131, 92, 133; 254/213, 254/242, 243, 376; 212/167, 120
See application file for complete search history.

(56) References Cited

U.S. PATENT DOCUMENTS 966,828 A * 8/1910 Habben ..... 254/213
1,432,998 A * 10/1922 Grau ..... 269/46
2,576,755 A * 11/1951 Gaskins et al. ..... 182/235
3,062,543 A * 11/1962 Shaboo et al. ..... 482/110
3,704,886 A * 12/1972 Kay et al. ..... 482/62
3,848,870 A * 11/1974 Craig ..... 482/44
4,284,272 A * 8/1981 Evans et al. ..... 482/72
4,445,684 A * 5/1984 Ruff ..... 482/131
4,538,804 A * 9/1985 Zibell ..... 482/57
4,824,132 A * 4/1989 Moore ..... 280/304.1
4,993,407 A * 2/1991 Chen ..... 601/36
5,037,087 A * 8/1991 Roth ..... 482/93
5,147,266 A * 9/1992 Ricard ..... 482/131
5,254,060 A * 10/1993 Bohanan ..... 482/60
5,324,245 A * 6/1994 Fontana et al. ..... 482/131
6,110,183 A * 8/2000 Cope ..... 606/139
6,689,025 B2 * 2/2004 Emick ..... 482/123
6,887,187 B1 * 5/2005 Renz ..... 482/57

* cited by examiner

*Primary Examiner*—Loan H Thanh
*Assistant Examiner*—Sandhara M Ganesan

(57) ABSTRACT

A hand-held exercise device includes left and right handles that rotate through respective paths about an axis that is centrally located between the handles. In one mode of operation, the device is rotated while walking to enhance aerobic exercise. In another mode of operation, a strap is secured between the device and at least one of a person's lower limbs to link rotation of the device to movement of the person's hands and at least one of the person's lower limbs toward one another, thereby assisting the person in the performance of abdominal exercises and/or muscle stretching.

18 Claims, 17 Drawing Sheets

Fig. 8
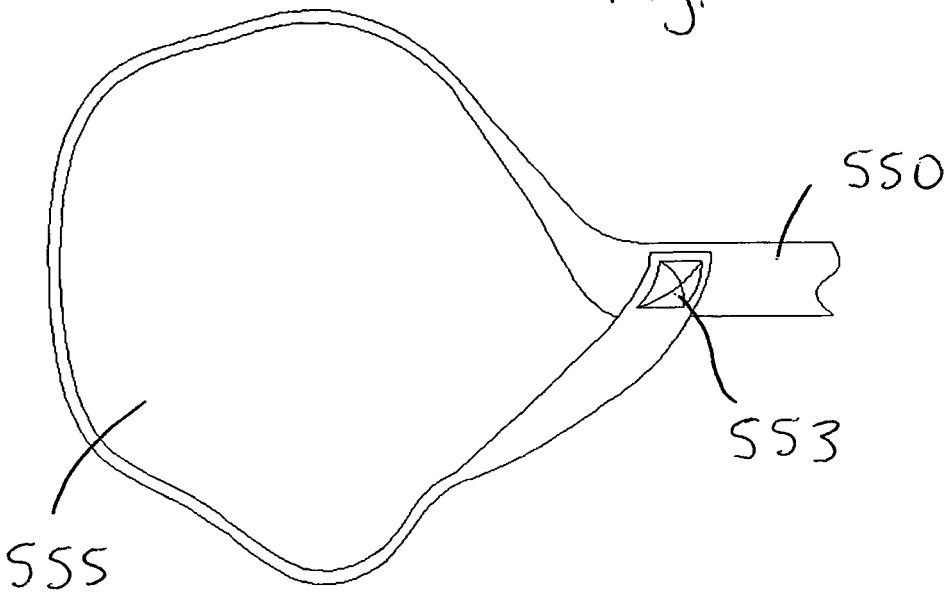
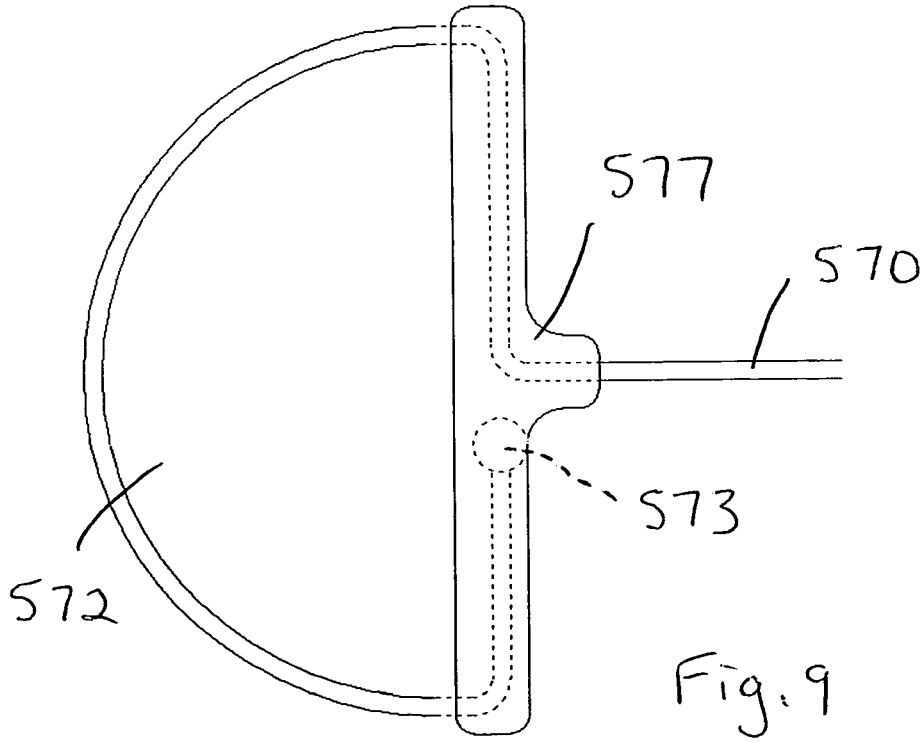
Fig. 9

Fig. 10a
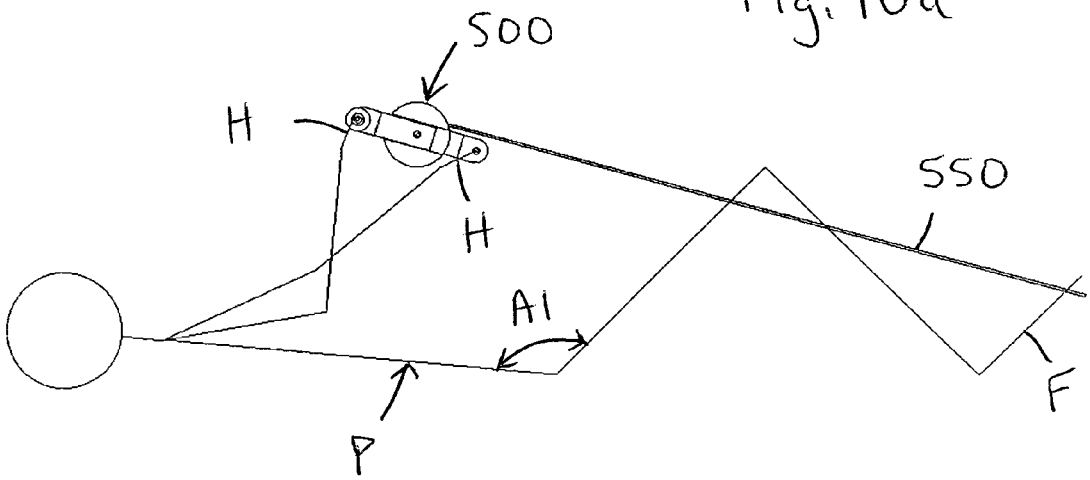
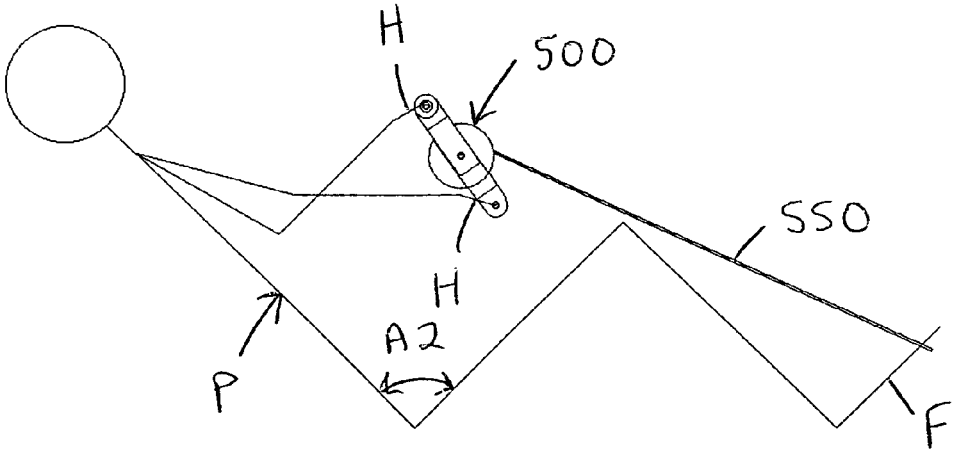
Fig. 10b

Fig. 11a
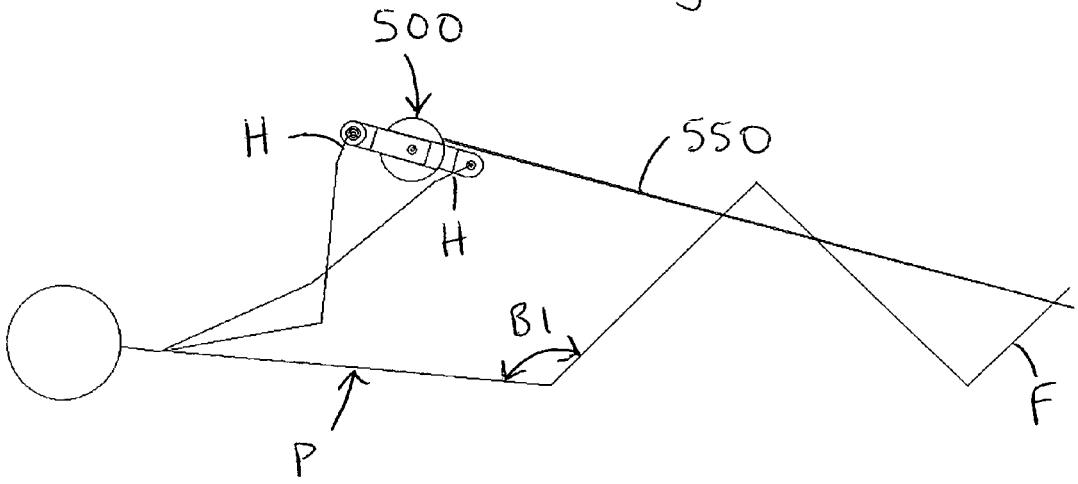
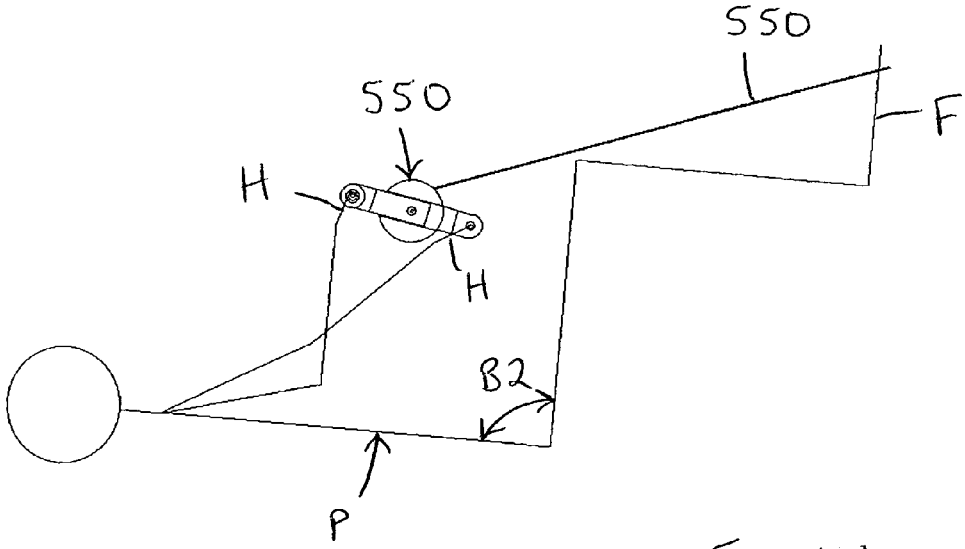
Fig. 11b

EXERCISE METHODS AND APPARATUS

CROSS-REFERENCE TO RELATED APPLICATION

Disclosed herein is subject matter that is entitled to the earlier filing date of U.S. Provisional Application No. 60/717,489, filed Sep. 14, 2005.

FIELD OF THE INVENTION

The present invention relates to exercise devices and methods involving same.

BACKGROUND OF THE INVENTION

Various devices and methods have been devised to facilitate exercise. Despite many advances in this field, room for new and improved products remains. An object of the present invention is to provide innovative exercise methods and apparatus that are easy to use and effective in use.

SUMMARY OF THE INVENTION

A preferred embodiment of the present invention may be described as a hand-held device having a central base and diametrically opposed handles that project outward from respective sides of the base. According to one aspect of the present invention, the handles are maneuvered in a manner that rotates the base for purposes of toning upper body muscles and/or performing aerobic exercise. This activity may be performed in a stationary position or in connection with other exercise activity, such as walking.

According to another aspect of the present invention, the base is configured as a drum, and a strap or other flexible member is secured to the drum. In this scenario, rotation of the drum causes the strap to wind about the drum or unwind from the drum, depending on the direction of rotation. By securing a discrete portion of the strap about a lower extremity, a user can use this configuration to facilitate abdominal exercises and/or muscle stretching. For example, winding of the strap may be performed to pull a person's knees and chest toward one another.

BRIEF DESCRIPTION OF THE FIGURES OF THE DRAWING

With reference to the Figures of the Drawing, wherein like numerals represent like parts and assemblies throughout the several views.

FIG. 8 is a front view of a first anchor arrangement suitable for use on the exercise device of FIG. 6;

FIG. 9 is a front view of a second anchor arrangement suitable for use on the exercise device of FIG. 6;

FIGS. 10*a* and 10*b* are diagrammatic side views showing a person using the exercise device of FIG. 6 to perform an abdominal crunch exercise;

FIGS. 11*a* and 11*b* are diagrammatic side views showing a person using the exercise device of FIG. 6 to perform a leg lift exercise;

DETAILED DESCRIPTION OF A PREFERRED EMBODIMENT

Figures 1, 2:
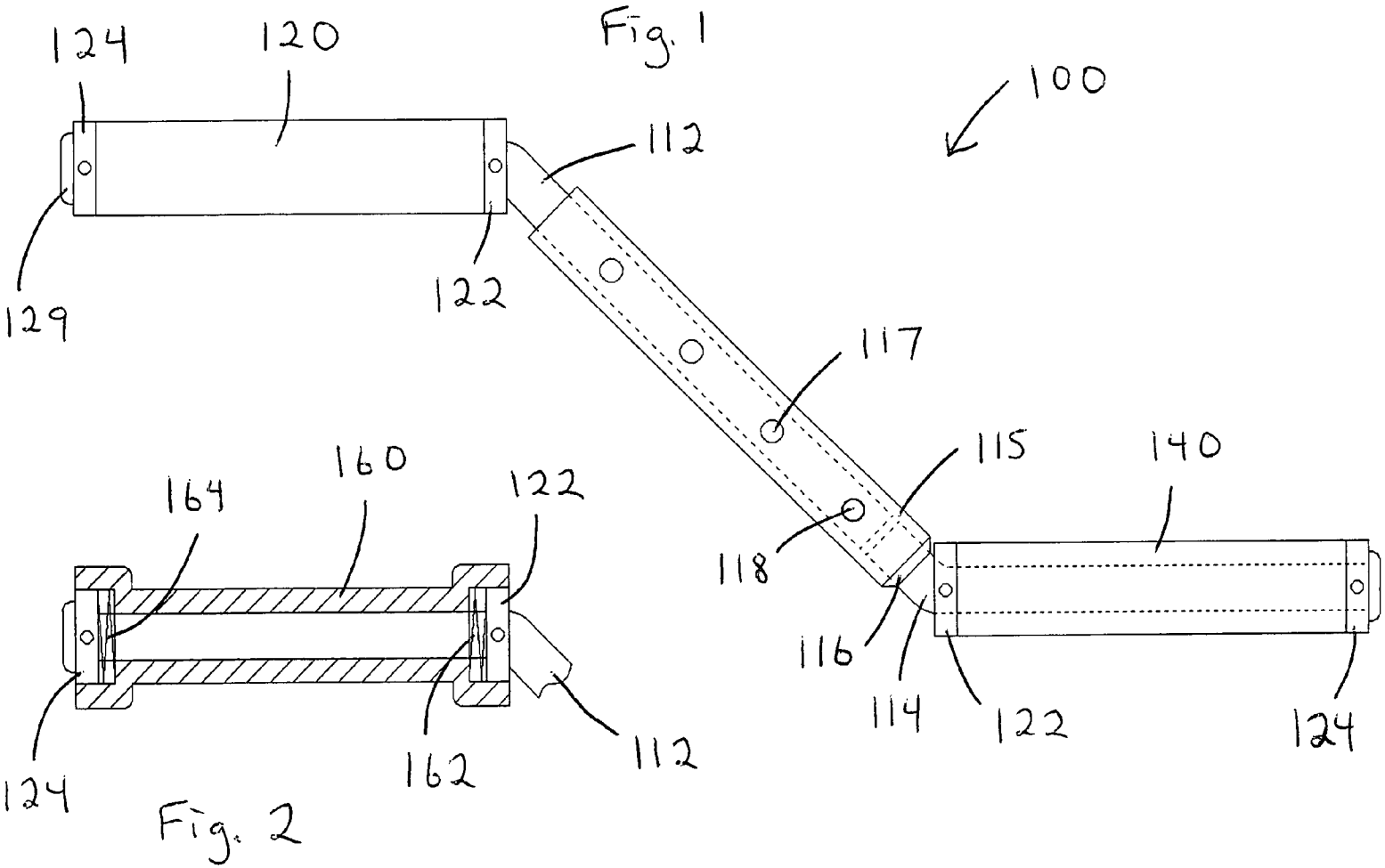
FIG. 1 is a front view of a first exercise device constructed according to the principles of the present invention.
FIG. 2 is a partially sectioned front view of an alternative handle suitable for use on the exercise device of FIG. 1.

FIG. 1 shows a first exercise device 100 constructed according to the principles of the present invention. The device 100 includes left and right handles 120 and 140 that are interconnected for cooperative rotational movement about an axis (the axis preferably extends parallel to the handles 120 and 140 and is centrally located therebetween). The components interconnected between the handles 120 and 140 may be described as a support or frame portion of the device 100.

The left handle 120 may be described in terms of a rigid tubular hand grip rotatably mounted on one end of a generally V-shaped steel tube 112. The left handle 120 is maintained in place on the tube 112 by means of set collars 122 and 124, which are secured to the tube 112 by respective spring pins or other suitable means. An end cap 129 is preferably inserted into the distal end of the tube 112 and secured in place by the respective spring pin. In the alternative, the end cap 129 may be provided as an integral portion of the outer set collar 124. For reasons discussed below, a hole is formed in an opposite distal end portion of the tube 112, and a snap button 118 is configured and arranged to protrude outward therefrom.

The right handle 140 may be similarly described in terms of a rigid tubular hand grip rotatably mounted on one end of another generally V-shaped steel tube 114. The right handle 140 is maintained in place on the tube 114 by similar set collars 122 and 124 or other suitable means. An opposite, shorter end of the tube 114 is secured to a larger diameter steel tube 115 by welding (shown at 116) or other suitable means. The larger tube 115 is configured to receive the "snap button end" of the tube 112 in telescoping fashion, and the snap button 118 protrudes through any one of several holes 117 in the larger tube 115 to adjustably secure the two tubes 112 and 114 in place relative to one another. As a result of this arrangement, both the crank diameter and the axially spacing defined between the handles 120 and 140 may be adjusted.

Another aspect of the present invention involves methods of using the device 100. In this regard, a person grasps the handles 120 and 140 in respective hands, lifts the device 100, and moves the handles 120 and 140 through respective circular paths. The device 100 may be held in different positions (e.g. out in front, overhead) while the handles 120 and 140 are rotated, in order to focus effort on various muscles and/or muscle connection points. Furthermore, the person may exert opposing left and right pushing or pulling forces against respective handles 120 and 140 (in opposite directions parallel to the handles) while rotating same, in order to involve additional muscles and/or muscle connection points.

FIG. 2 shows an alternative embodiment handle 160 that may be substituted for the handles 120 and 140. The handle 160 includes helical coil springs 162 and 164 that are compressed between respective set collars 122 and 124 and respective bearing surfaces on the tubular hand grip. This arrangement provides sensory feedback to a person exerting the opposing pushing forces or pulling forces discussed in the previous paragraph.

Figure 3:
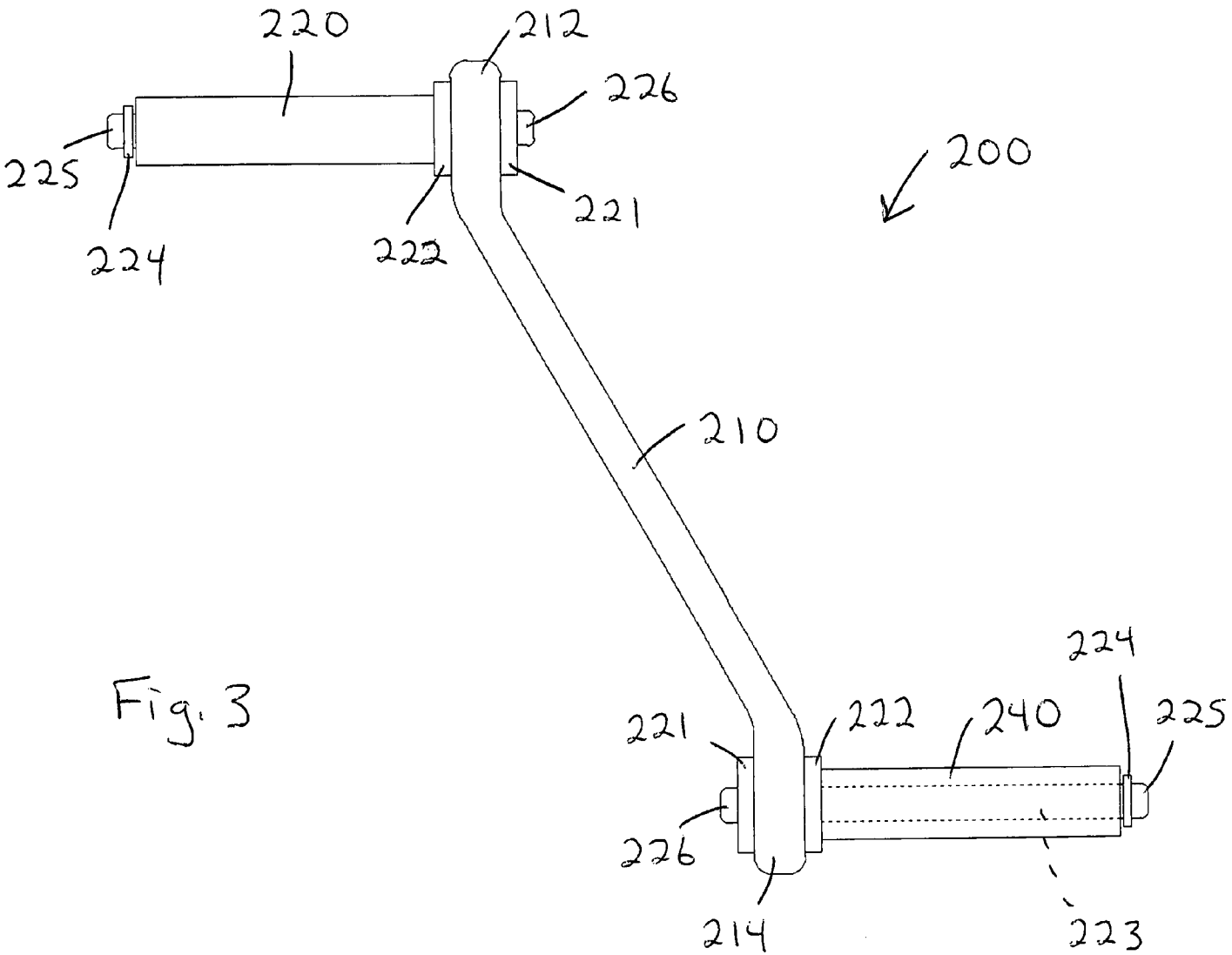
FIG. 3 is a front view of a second exercise device constructed according to the principles of the present invention.

FIG. 3 shows a second exercise device 200 constructed according to the principles of the present invention. The device 200 includes left and right handles 220 and 240 that are interconnected for cooperative rotational movement about an axis (which extends parallel to the handles 220 and 240 and is centrally located therebetween). The components interconnected between the handles 220 and 240 may be described as a support or frame portion of the device 200.

The right handle 240 may be described in terms of a rigid tubular hand grip rotatably mounted on one end 214 of a resilient bar 210 (preferably made of rubber). More specifically, the hand grip is rotatably mounted on a sleeve 223, which in turn is secured to the bar end 214. In this regard, a bolt 225 is inserted through a washer 224, then through the sleeve 223, a first larger washer 222, the bar end 214, and a second larger washer 221. A nut 226 is then secured to the protruding distal end of the bolt 225. The nut 226 and the bolt 225 cooperate with the intermediate components to secure the sleeve in place relative to the bar 210, while allowing the hand grip to rotate relative thereto.

The left handle 220 may be similarly described in terms of a rigid tubular hand grip rotatably mounted on an opposite end 212 of the resilient bar 210. More specifically, the hand grip is rotatably mounted on a sleeve 223, which in turn is secured to the bar end 212. In this regard, a bolt 225 is inserted through a washer 224, then through the sleeve 223, a first larger washer 222, the bar end 214, and a second larger washer 221. A nut 226 is then secured to the protruding distal end of the bolt 225. The nut 226 and the bolt 225 cooperate with the intermediate components to secure the sleeve in place relative to the bar 210, while allowing the hand grip to rotate relative thereto.

The present invention may also be described in terms of methods of using the device 200. In this regard, a person grasps the handles 220 and 240 in respective hands, lifts the device 200, and moves the handles 220 and 240 through respective circular paths. The device 200 may be held in different positions (e.g. out in front, overhead) while the handles 220 and 240 are rotated, in order to focus effort on various muscles and/or muscle connection points. Furthermore, the person may exert opposing left and right pushing or pulling forces against respective handles 220 and 240 (parallel to the handles) while rotating same, in order to involve additional muscles and/or muscle connection points. The bar 210 is configured to resiliently flex in response to sufficient pushing or pulling forces exerted through the handles 220 and 240, and thereby accommodate changes in both the crank diameter and the axially spacing defined between the handles 220 and 240. Moreover, the bar 210 is also preferably configured and arranged to encourage a parallel relationship between the handles 220 and 240 and the central axis of rotation (proximate the lead line for reference number 210).

Figure 4:
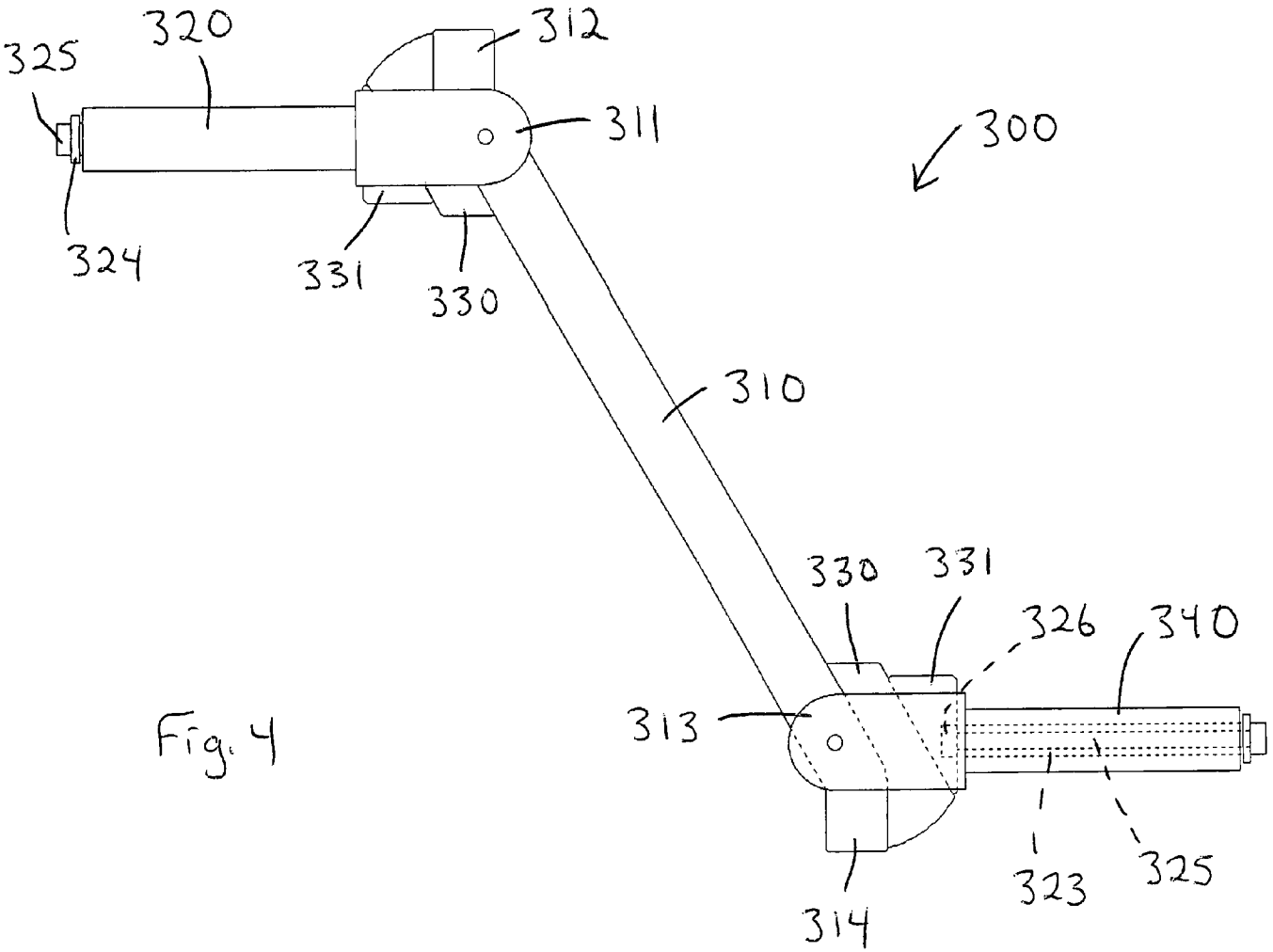
FIG. 4 is a front view of a third exercise device constructed according to the principles of the present invention.

FIG. 4 shows a third exercise device 300 constructed according to the principles of the present invention. The device 300 includes left and right handles 320 and 340 that are interconnected for cooperative rotational movement about an axis (which extends parallel to the handles 320 and 340 and is centrally located therebetween). The components interconnected between the handles 320 and 340 may be described as a support or frame portion of the device 300.

The right handle 340 may be described in terms of a rigid tubular hand grip rotatably mounted on one end of a rigid bar 310 (preferably made of steel). More specifically, the hand grip is rotatably mounted on a sleeve 323 (similar to the sleeve 223 described above). As on the previous embodiment 200, a bolt 325 is inserted through a washer 324, and then through the sleeve 323. In this case, however, the bolt is thereafter inserted through the base of a trunnion 312 and an associated wedge member 331, and then a nut 326 is secured to the protruding distal end of the bolt 325. The nut 326 and the bolt 325 cooperate with the intermediate components to secure the sleeve 323 in place relative to the trunnion 312, while allowing the hand grip to rotate about the sleeve 323.

The trunnion 312 is rotatably mounted on the end of the bar 310 (by a rivet or other suitable means) for rotation about an axis that extends perpendicular to the rotational axis of the tubular hand grip (and perpendicular to the drawing plane of FIG. 4, as well). A resilient block 330 (preferably made of rubber) is sandwiched between the wedge member 331 and the bar 310 (including distal end 314) to bias the handle 340 toward the orientation shown in FIG. 4 (relative to the bar 310).

The left handle 320 may be similarly described in terms of a rigid tubular hand grip rotatably mounted on an opposite end of the bar 310. More specifically, the hand grip is rotatably mounted on a similar sleeve 323, and a bolt 325 is inserted through a washer 324, the sleeve 323, a similar trunnion 311 and a similar wedge member 331. A nut 326 is then secured to the protruding distal end of the bolt 325. The nut 326 and the bolt 325 cooperate with the intermediate components to secure the sleeve 323 in place relative to the trunnion 311, while allowing the hand grip to rotate about the sleeve 323. The trunnion 311 is similarly mounted on the respective end of the bar 310, and a similar resilient block 330 is sandwiched between the wedge member 331 and the bar 310 (including distal end 312) to bias the handle 320 toward the orientation shown in FIG. 4 (relative to the bar 310).

The present invention may also be described in terms of methods of using the device 300. In this regard, a person grasps the handles 320 and 340 in respective hands, lifts the device 300, and moves the handles 320 and 340 through respective circular paths. The device 300 may be held in different positions (e.g. out in front, overhead) while the handles 320 and 340 are rotated, in order to focus effort on various muscles and/or muscle connection points. Furthermore, the person may exert opposing left and right pushing or pulling forces against respective handles 320 and 340 (parallel to the handles) while rotating same, in order to involve additional muscles and/or muscle connection points. The resilient blocks 330 are configured to resiliently flex in response to sufficient pushing or pulling forces exerted through the handles 320 and 340 to accommodate changes in both the crank diameter and the axially spacing defined between the handles 320 and 340 (while preferably encouraging a parallel relationship between the handles 320 and 340 and the central axis of rotation (proximate the lead line for reference number 310).

Figure 5:
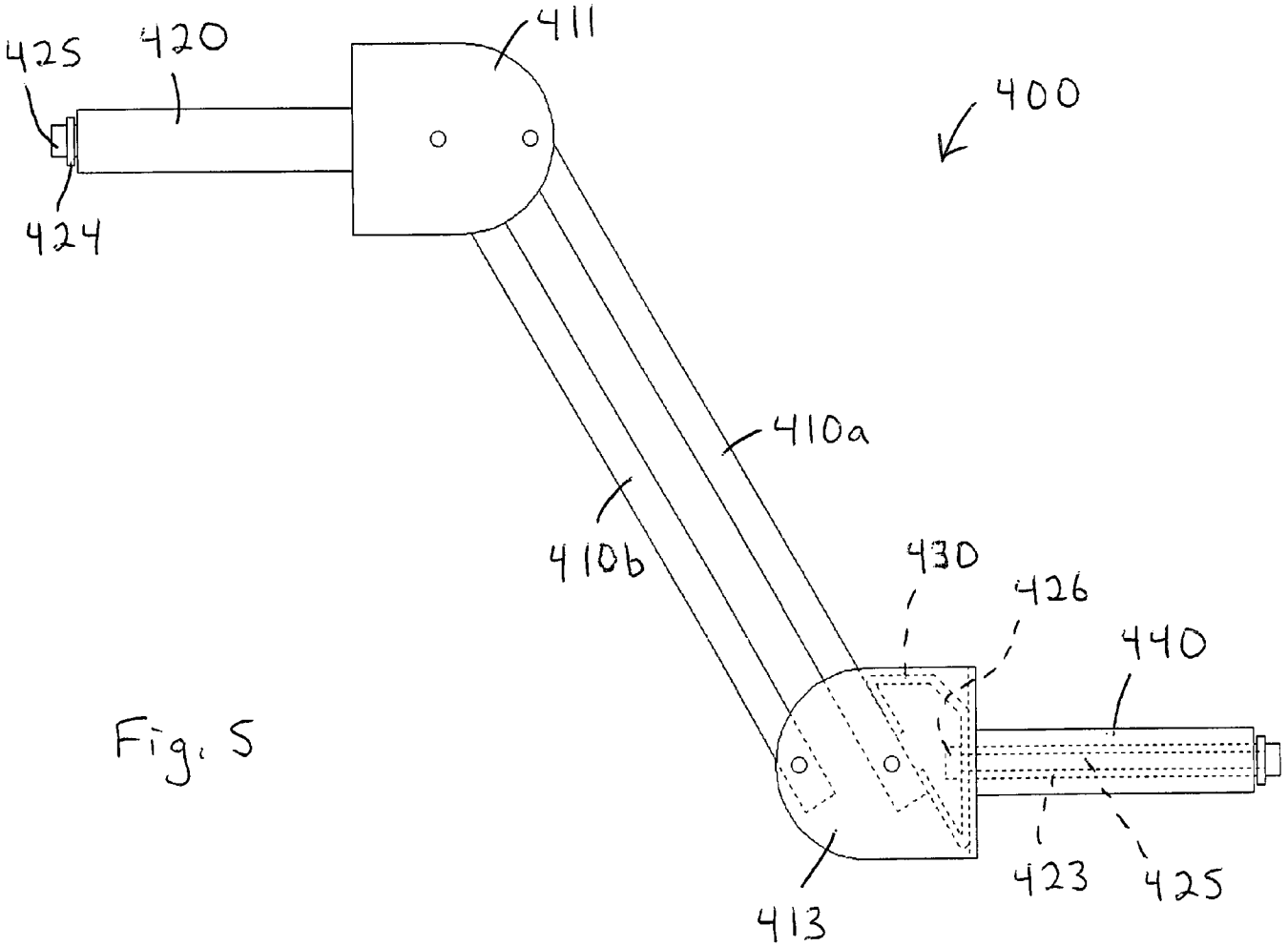
FIG. 5 is a front view of a fourth exercise device constructed according to the principles of the present invention.

FIG. 5 shows a fourth exercise device 400 constructed according to the principles of the present invention. The device 400 includes left and right handles 420 and 440 that are interconnected for cooperative rotational movement about an axis (which extends parallel to the handles 420 and 440 and is centrally located therebetween). The components interconnected between the handles 420 and 440 may be described as a support or frame portion of the device 400.

The right handle 440 may be described in terms of a rigid tubular hand grip rotatably mounted on adjacent ends of respective rigid bars 410*a* and 410*b* (preferably made of steel). More specifically, the hand grip is rotatably mounted on a sleeve 423 (similar to the sleeves 223 and 323 described above). As on the previous embodiment 300, a bolt 425 is inserted through a washer 424, the sleeve 323, and the base of a trunnion 413. In this case, however, the bolt 425 is thereafter inserted through a leaf spring 430 (preferably made of spring steel), and then a nut 426 is secured to the protruding distal end of the bolt 425. The nut 426 and the bolt 425 cooperate with the intermediate components to secure the sleeve 423 in place relative to the trunnion 413, while allowing the hand grip to rotate about the sleeve 423.

The trunnion 413 is rotatably mounted on adjacent ends of respective bars 410*a* and 410*b* (by rivets or other suitable means) for rotation about parallel axes that extend perpendicular to the rotational axis of the tubular hand grip (and perpendicular to the drawing plane of FIG. 5, as well). Opposite ends of the leaf spring 430 bear against respective portions of the bar 410*a* to bias the handle 440 toward the orientation shown in FIG. 5 (relative to the bar 410).

The left handle 420 may be similarly described in terms of a rigid tubular hand grip rotatably mounted on opposite ends of respective rigid bars 410*a* and 410*b*. More specifically, a bolt 425 is inserted through a washer 424, a sleeve 323, the base of a similar trunnion 411, and a similar leaf spring 430. A nut 426 is then secured to the protruding distal end of the bolt 425. The nut 426 and the bolt 425 cooperate with the intermediate components to secure the sleeve 423 in place relative to the trunnion 411, while allowing the hand grip to rotate about the sleeve 423.

The trunnion 411 is similarly rotatably mounted on the opposite ends of respective bars 410*a* and 410*b* for rotation about parallel axes that extend perpendicular to the rotational axis of the tubular hand grip (and perpendicular to the drawing plane of FIG. 5, as well). Opposite ends of the leaf spring 430 bear against respective portions of the bar 410*b* to bias the handle 420 toward the orientation shown in FIG. 5 (relative to the bar 410). Also, the bars 410*a* and 410*b* cooperate with the trunnions 411 and 413 to define a four-bar linkage that maintains the handles 420 and 440 parallel to one another.

The present invention may also be described in terms of methods of using the device 400. In this regard, a person grasps the handles 420 and 440 in respective hands, lifts the device 400, and moves the handles 420 and 440 through respective circular paths. The device 400 may be held in different positions (e.g. out in front, overhead) while the handles 420 and 440 are rotated, in order to focus effort on various muscles and/or muscle connection points. Furthermore, the person may exert opposing left and right pushing or pulling forces against respective handles 420 and 440 (parallel to the handles) while rotating same, in order to involve additional muscles and/or muscle connection points. The leaf springs 430 are configured to resiliently flex in response to sufficient pushing or pulling forces exerted through the handles 420 and 440 to accommodate changes in both the crank diameter and the axially spacing defined between the handles 420 and 440 (while the dual bars 410*a* and 410*b* maintain a parallel relationship between the handles 420 and 440 and the central axis of rotation (proximate a central location between the lead lines for reference numbers 410*a* and 410*b*).

Figure 6:
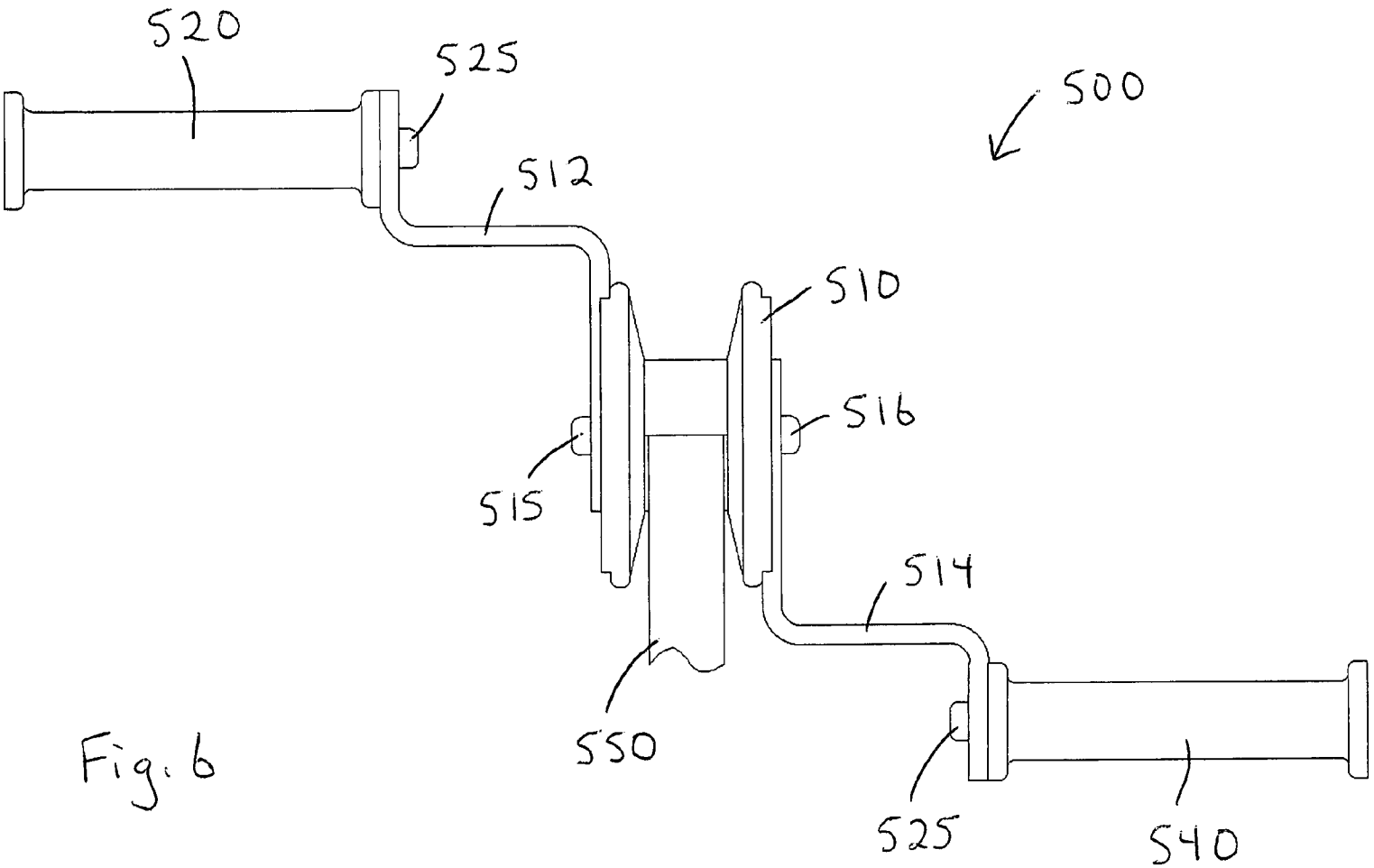
FIG. 6 is a front view of a fifth exercise device constructed according to the principles of the present invention.
Figure 7:
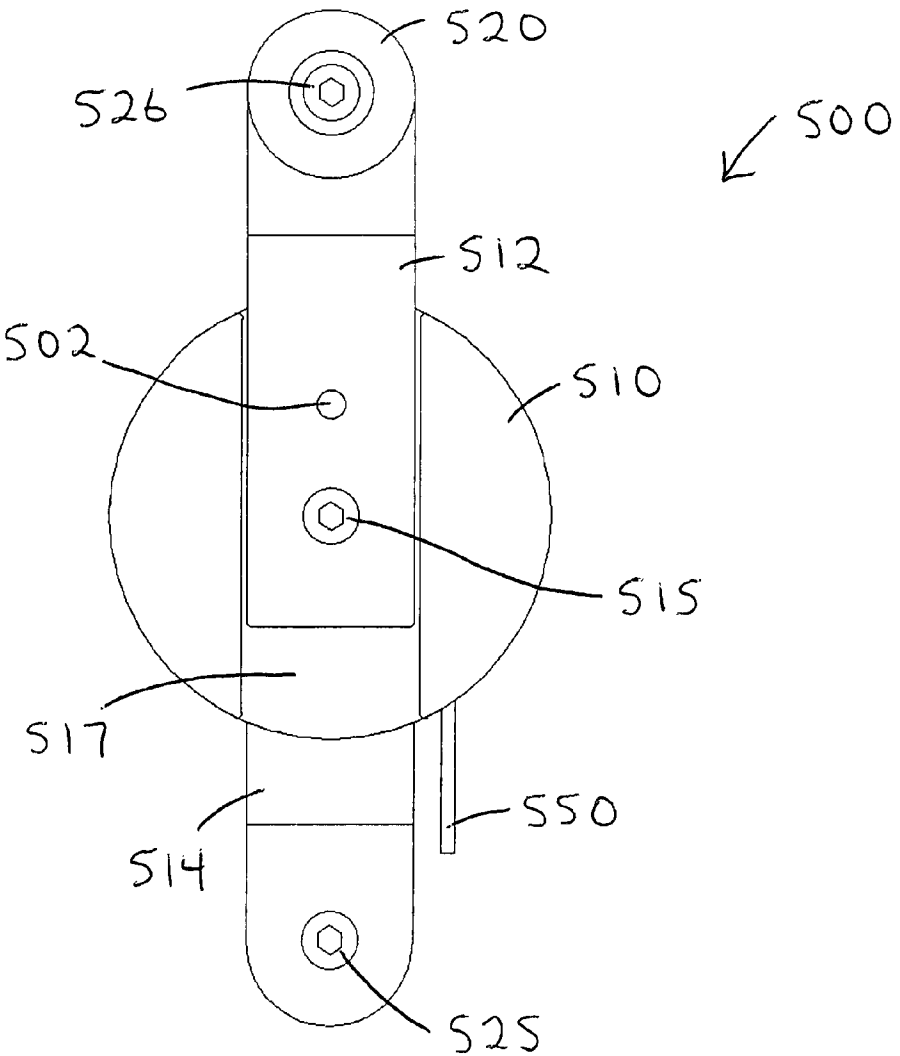
FIG. 7 is a side view of the exercise device of FIG. 6.

FIGS. 6-7 show a fifth exercise device 500 constructed according to the principles of the present invention. The device 500 includes left and right handles 520 and 540 that are interconnected for cooperative rotational movement about an axis (which extends parallel to the handles 520 and 540 and is centrally located therebetween). The components interconnected between the handles 520 and 540 may be described as a support or frame portion of the device 500.

The left handle 520 may be described in terms of a rigid tubular hand grip rotatably mounted on an outboard end of a bar 512. In this regard, a bolt 525 is inserted through the bar 512, and then an open-ended nut (not shown) is threaded tightly onto the bolt and against the bar 512. The remaining distal portion of the bolt 525 is inserted through the hand grip, and then a closed-ended nut 526 (shown in FIG. 7) is threaded tightly onto the bolt 525. The bolt 525 is sufficiently long to loosely accommodate the hand grip between respective nuts, and the outboard end of the hand grip is preferably configured to shroud the nut 526. Those skilled in the art will recognize that the sleeve arrangements described above with reference to previous embodiments may be used in the alternative to rotatably mount the hand grip to the bar 512.

The right handle 540 may be similarly described in terms of a rigid tubular hand grip rotatably mounted in like fashion on an outboard end of another bar 514. An opposite, inboard end of each bar 512 and 514 is secured to a respective side of a central drum or sheave 510. On the depicted device 500, a bolt 515 is inserted through a hole in the bar 512, a central hub portion of the sheave 510, and then a hole in the bar 514. A nut 516 is then threaded tightly onto a protruding distal end of the bolt 515. At least one alternative hole 502 is provided in each bar 512 and 514 to alternatively align with the hole through the sheave 510, and thereby accommodate adjustment of the crank diameter defined between the handles 520 and 540. Each bar 512 and 514 nests inside a respective recess 517 in the sheave 510, thereby constraining the sheave 510 and the bars 512 and 514 to rotate together as a unit, as well as facilitating alignment of the holes.

A flexible member 550 (depicted as a Nylon strap in FIGS. 6-8) has a first end secured to the hub portion of the sheave 510 for winding or wrapping about the hub portion. This end portion may be secured in place by various known means, including clamping. An opposite, second end of the flexible member 550 is configured to anchor beneath a person's foot or feet and/or behind a person's lower thighs (just above the knee). For example, FIG. 8 shows the second end formed into a closed loop 555 with the distal end secured to an intermediate portion of the member 550 by stitching (in the region 553). This loop may be arranged about a person's legs just above the knees, or about a person's feet. Also, the loop may be "double wrapped" about one foot, if desired.

FIG. 9 shows an alternative anchor arrangement using a cord 570 in lieu of the strap 550 shown in FIGS. 6-8 (to emphasize that the flexible member may take various forms). The distal end of the cord 570 is threaded into a central portion of a bar 577 (preferably injection molded plastic), then out one end of the bar 577 (the upper end in FIG. 9), then through an opposite end of the bar 577 (the lower end in FIG. 9), and then secured in place at 573 proximate the central portion of the bar 577 (by a knot or other suitable means). This arrangement defines a closed loop 572 that may be adjusted to accommodate different needs (including anchoring relative to a single foot, for example). Moreover, the loop 572 may be essentially closed by pulling the cord 570 snug against the bar 577, in which case, the bar 577 may be anchored behind the person's feet or lower thighs. If this last configuration is deemed the only necessary option, then the cord 570 may simply be anchored to the bar 577 at its center (by a knot or other suitable means) without forming any closed loop.

The present invention may also be described in terms of methods of using the device 500. For example, FIGS. 10*a*-10*b* show a person P using the device 500 to perform an abdominal crunch exercise. Having secured the flexible member 550 beneath his feet F, grasped the handles 520 and 540 in his respective hands H, and lifted the device 500, the person P moves the handles 520 and 540 through respective circular paths (centered about the longitudinal axis of the bolt 515), thereby winding the flexible member 550 about the sheave 510. The angles designated as A1 and A2 show how the angle between the person's torso and thighs decreases as more of the flexible member 550 is wound onto the sheave 510. Those skilled in the art will also recognize that conversely, this angle increases as the flexible member 550 unwinds from the sheave 510 (going from FIG. 10*b* to FIG. 10*a*). Moreover, the direction of winding required to move from A1 to A2 may be reversed by flipping the device 500 so that the handles 520 and 540 are held in opposite hands.

FIGS. 11*a*-11*b* show a person P using the device 500 to perform a leg lift exercise. Having secured the flexible member 550 beneath his feet F, grasped the handles 520 and 540 in his respective hands H, and lifted the device 500, the person P moves the handles 520 and 540 through respective circular paths (centered about the longitudinal axis of the bolt 515), thereby winding the flexible member 550 about the sheave 510. The angles designated as B1 and B2 show how the angle between the person's torso and thighs decreases as more of the flexible member 550 is wound onto the sheave 510. Those skilled in the art will also recognize that conversely, this angle increases as the flexible member 550 unwinds from the sheave 510 (going from FIG. 11*b* to FIG. 11*a*). Moreover, the direction of winding required to move from B1 to B2 may be reversed by flipping the device 500 so that the handles 520 and 540 are held in opposite hands.

The methods described in the two preceding paragraphs may be described more generally as an abdominal exercise method involving the steps of providing an exercise device having diametrically opposed left and right handles that rotate about a common axis; linking rotation of the handles about the axis to variation in an angle defined between a person's thighs and a person's torso; and encouraging a person to contemporaneously rotate the handles about the axis while contracting his abdominal muscles.

Figure 12A:
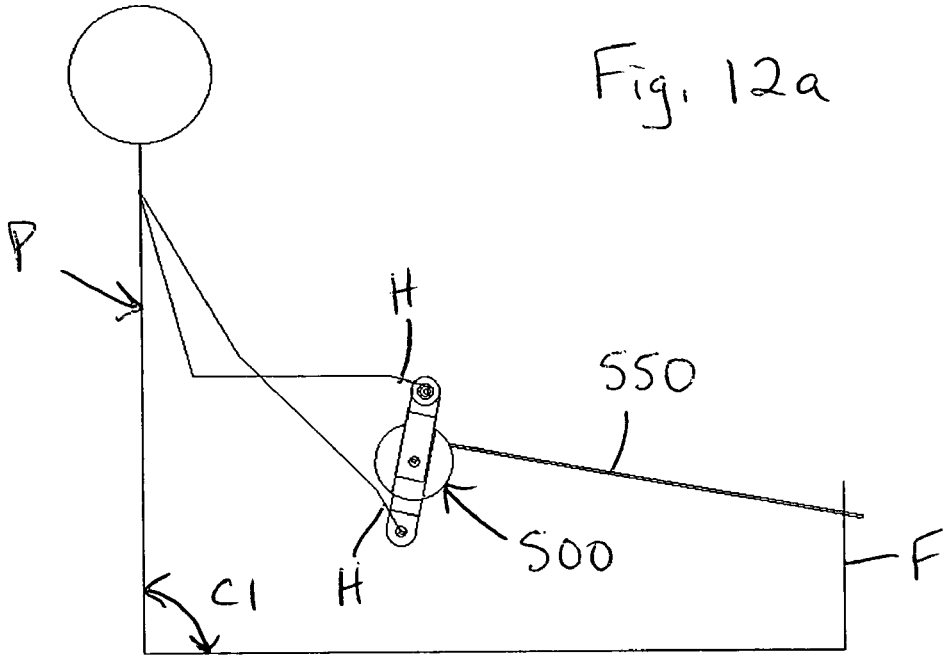
FIGS. 12*a* and 12*b* are diagrammatic side views showing a person using the exercise device of FIG. 6 to perform a stretching exercise.
Figure 12B:
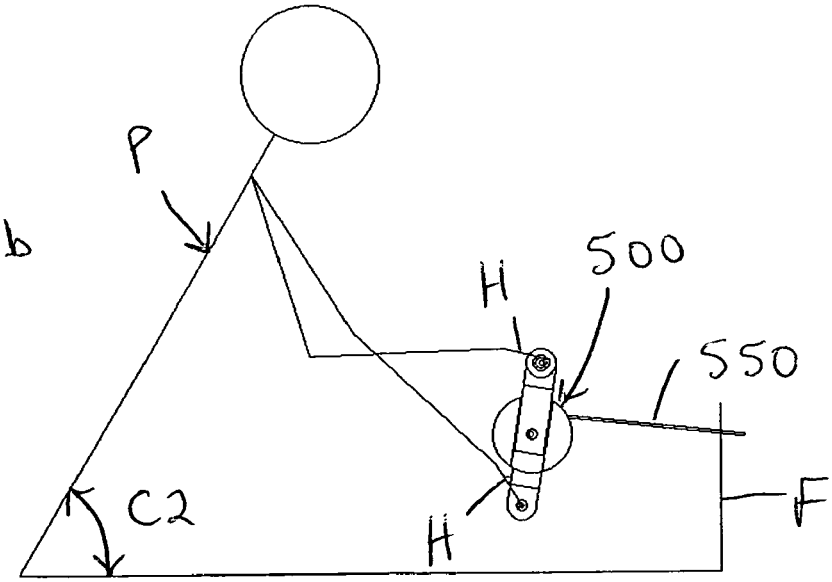

FIGS. 12*a*-12*b* show a person P using the device 500 to perform a basic stretching exercise. Having secured the flexible member 550 beneath his feet F, grasped the handles 520 and 540 in his respective hands H, and lifted the device 500, the person P moves the handles 520 and 540 through respective circular paths (centered about the longitudinal axis of the bolt 515), thereby winding the flexible member 550 about the sheave 510. The angles designated as C1 and C2 show how the angle between the person's torso and thighs decreases as more of the flexible member 550 is wound onto the sheave 510. Those skilled in the art will also recognize that conversely, the angle increases as the flexible member 550 unwinds from the sheave 510 (going from FIG. 12*b* to FIG. 12*a*). Moreover, the direction of winding required to move from C1 to C2 may be reversed by flipping the device 500 so that the handles 520 and 540 are held in opposite hands.

Figure 13B:
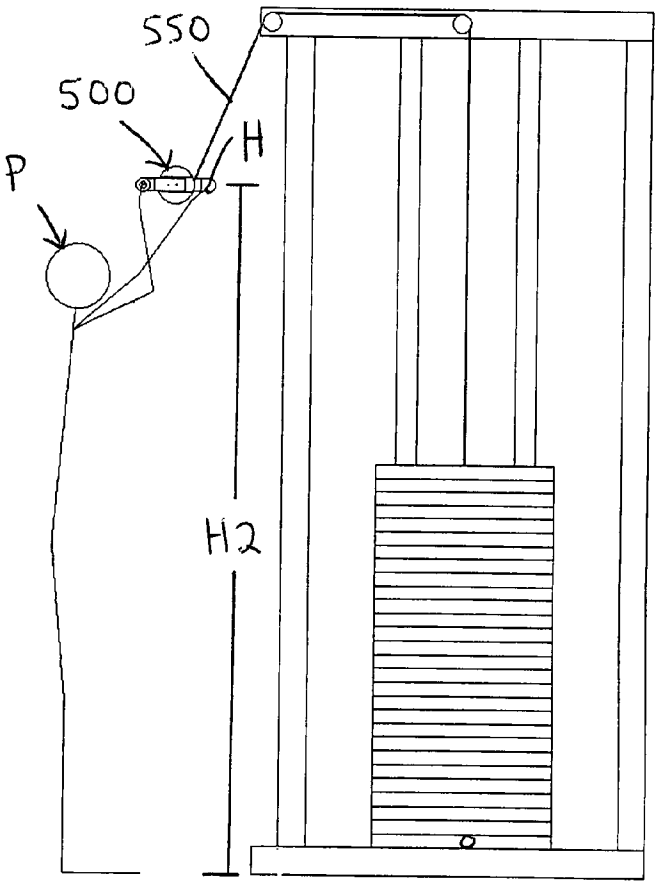
FIGS. 13*a* and 13*b* are diagrammatic side views showing a person using the exercise device of FIG. 6 to perform another stretching exercise.
Figure 13A:
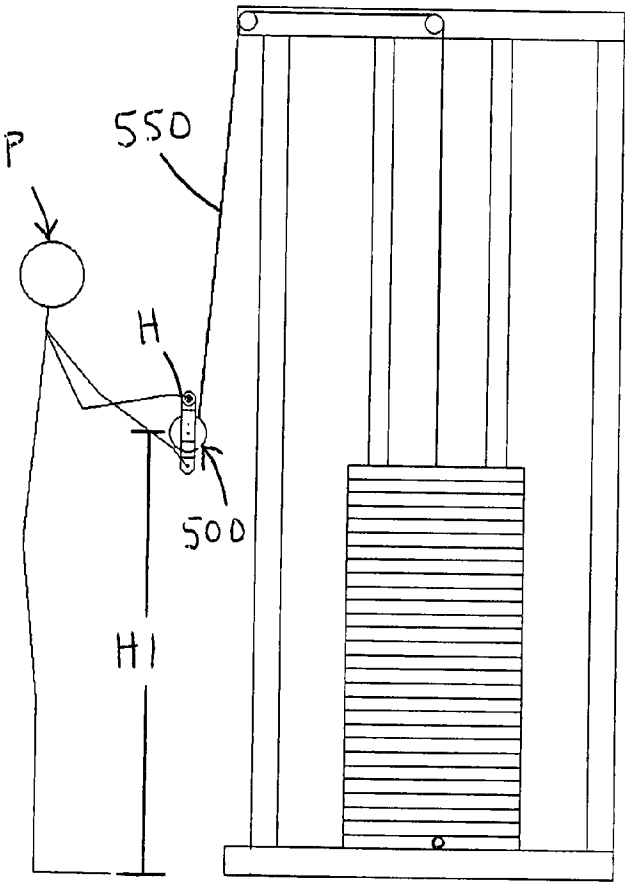

FIGS. 13*a*-13*b* show a person P using the device 500 to perform an alternative stretching exercise. Having secured the flexible member 550 to an overhead location, grasped the handles 520 and 540 in his respective hands H, and lifted the device 500, the person P moves the handles 520 and 540 through respective circular paths (centered about the longitudinal axis of the bolt 515), thereby winding the flexible member 550 about the sheave 510. The heights designated as H1 and H2 show how the person's hands H (and arms) rise as more of the flexible member 550 is wound onto the sheave 510. Those skilled in the art will also recognize that conversely, the height decreases as the flexible member 550 unwinds from the sheave 510 (going from FIG. 13*b* to FIG. 13*a*). Moreover, the direction of winding required to move from H1 to H2 may be reversed by flipping the device 500 so that the handles 520 and 540 are held in opposite hands.

Persons skilled in the art will recognize that additional exercises may be performed by arranging the device in different ways relative to a person and/or his surroundings. For example, a person may stand with the device 500 in hand and the distal end of the flexible member 550 secured about one of the person's feet. Winding of the flexible member 550 onto the sheave 510 will draw the person's foot upward, requiring the person to flex in a certain way to accommodate this movement while also maintaining balance on the other foot.

Figure 14B:
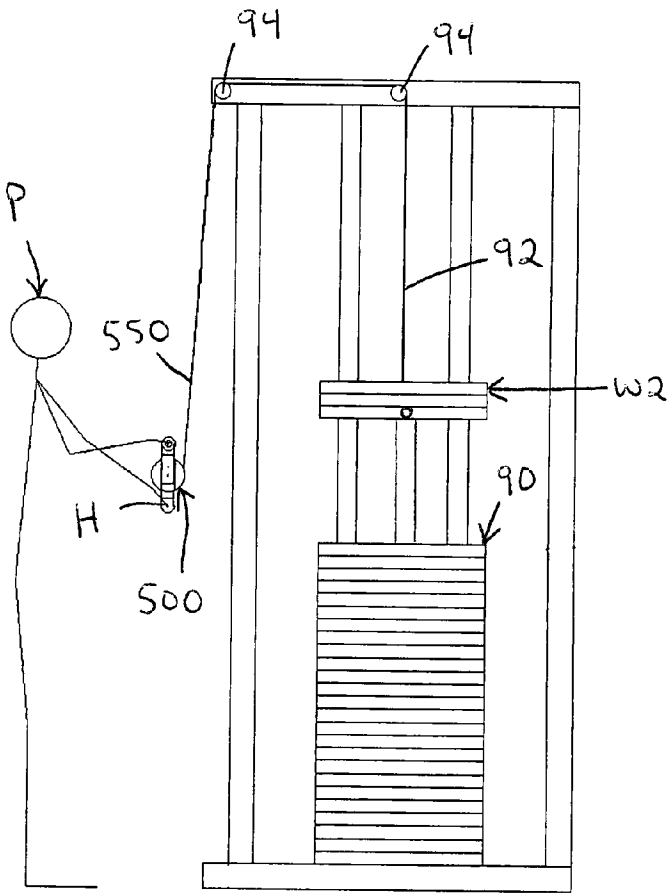
FIGS. 14*a* and 14*b* are diagrammatic side views showing a person using the exercise device of FIG. 6 to perform a weight lifting exercise.
Figure 14A:
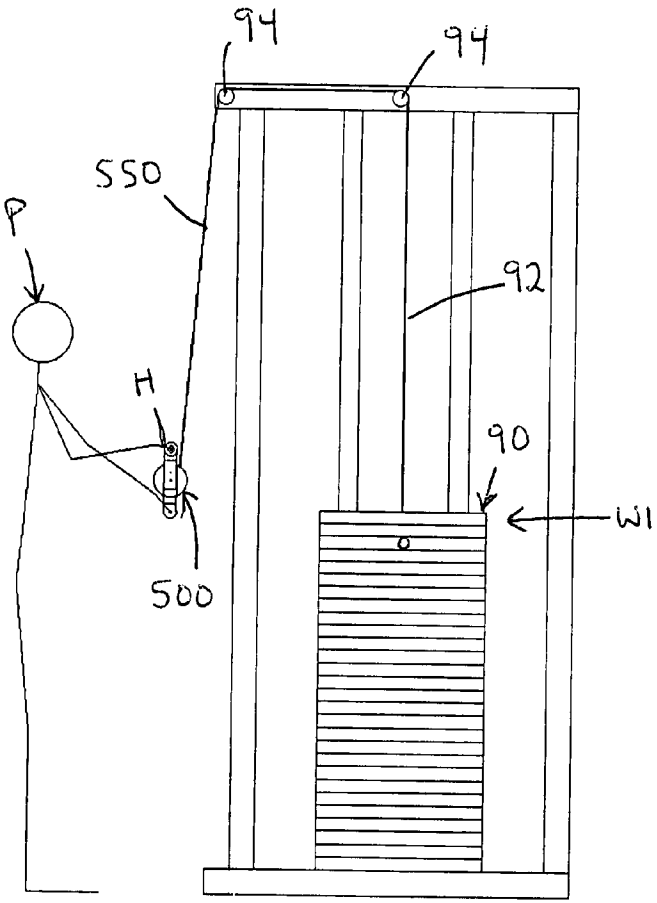

FIGS. 14*a*-14*b* show a person P using the device 500 to perform a weight lifting exercise. Having secured the flexible member 550 to an otherwise conventional weight stack 90 (via a cable 92 routed about at least one pulley 94), grasped the handles 520 and 540 in his respective hands H, and lifted the device 500, the person P moves the handles 520 and 540 through respective circular paths (centered about the longitudinal axis of the bolt 515), thereby winding the flexible member 550 about the sheave 510. The weight positions designated as W1 and W2 show how the weight rises as more of the flexible member 550 is wound onto the sheave 510 (while the device 500 is maintained in a relative constant location). Those skilled in the art will also recognize that conversely, the weight lowers as the flexible member 550 unwinds from the sheave 510 (going from FIG. 14*b* to FIG. 14*a*). Moreover, the direction of winding required to move from W1 to W2 may be reversed by flipping the device 500 so that the handles 520 and 540 are held in opposite hands.

The device 500 may also be used with the flexible member 550 removed or stowed, in order to more conveniently perform certain methods similar to those discussed above with reference to previous embodiments. In this regard, the device 500 may be held in different positions (e.g. out in front, overhead) while the handles 520 and 540 are rotated, in order to focus effort on various muscles and/or muscle connection points. Furthermore, the person may exert opposing left and right pushing or pulling forces against respective handles 520 and 540 (parallel to the handles) while rotating same, in order to involve additional muscles and/or muscle connection points.

Figure 15:
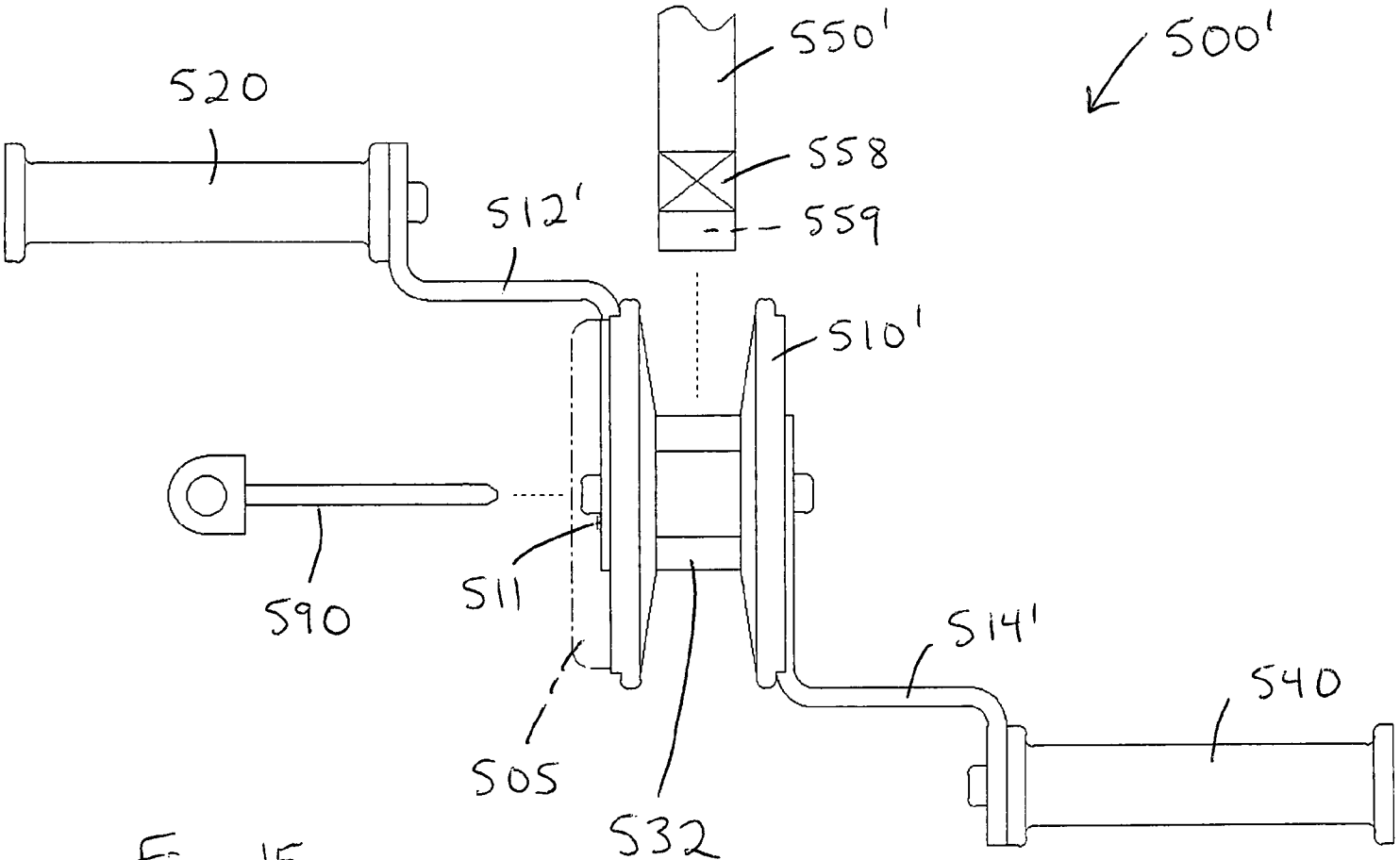
FIG. 15 is a front view of an alternative embodiment of the exercise device of FIG. 6.

FIG. 15 shows an alternative embodiment device 500' having certain optional features, including means for releasably securing the flexible member 550' to the sheave 510' and/or quickly releasing the flexible member 550' from the sheave 510'; means for more readily adjusting the crank diameter defined between the handles 520 and 540; and means for adjusting a hub perimeter defined by the sheave 510' to vary how much of the flexible member 550' is wound onto or off of the sheave 510' per revolution.

The quick release means for the flexible member 550' includes a detent pin 590 that is selectively insertable through a hole 519 in the sheave 510'. The proximal end of the flexible member 550' is secured to an adjacent portion of the flexible member 550' (by stitching 558 or other suitable means) to create a closed loop 559 at the resulting end of the flexible member 550'. The detent pin 590 is insertable through the closed loop 559, as well as the hole 519 in the sheave 510', to fasten the associated end of the flexible member 550' to the sheave 510' proximate the hub portion thereof. Those skilled in the art will recognize that various other arrangements may be used to releasably secure the flexible member 550' to the sheave 510', including, for example, providing a slot in the sheave 510' into which the end of the flexible member 550' slides axially.

The crank adjusting means is described with reference to the left side of the device 500' with the understanding that a similar arrangement is provided on the opposite, right side. The crank adjusting means includes a slot 531 in the bar 512' through which the bolt 515 is inserted. Also, two holes (one of which is designated as 502') extend through the bar 512' and are arranged to alternatively align with a snap button 511 or other suitable fastener on the sheave 510' when the bolt 515 occupies a respective end of the slot 531. As a result, the radially measured distance between the handles 520 and 540 may be readily adjusted by depressing the snap button 511 and sliding the bar 512' the appropriate direction to engage the desired hole in the bar 512'.

The hub adjusting means is also described with reference to the left side of the device 500', and with reference to aspects of the crank adjusting means, as well. In this regard, a hub portion 532 is rigidly mounted on the bar 512' and projects through a slot 533 in the sheave 510'. The hub portion 532 may be described generally as the lower one-fourth of a cylinder. An opposing, similarly shaped hub portion is rigidly mounted on the bar 514', and the hub portion disposed therebetween is rigidly mounted on the sheave 510'. When the bar 512' is adjusted to increase the crank diameter (as discussed in the preceding paragraph), the associated hub portion 532 is moved away from the intermediate hub portion on the sheave 510', thereby increasing the hub perimeter about which the flexible member 550' will be wound.

Figure 16:
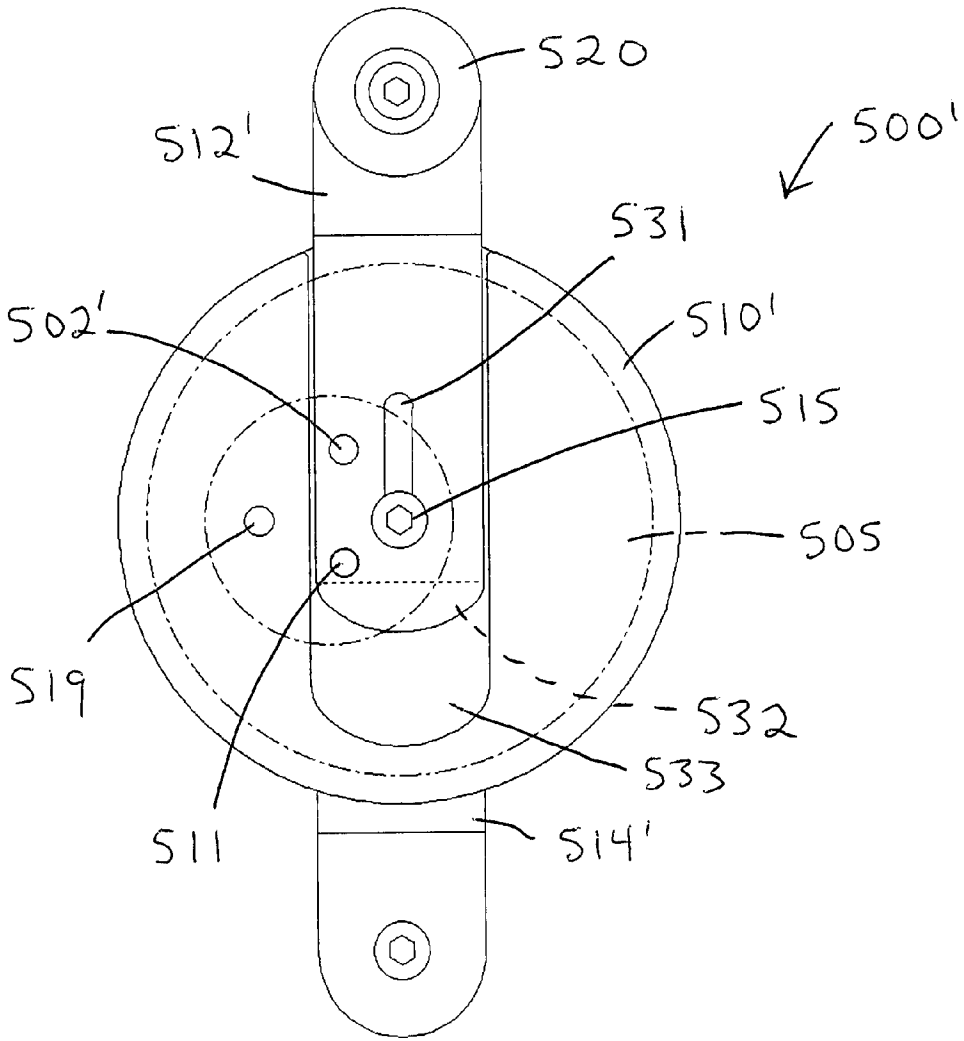
FIG. 16 is a side view of the embodiment of FIG. 15.

FIGS. 15-16 also show an optional cover or shroud 505 that may be secured to either or both sides of the sheave 510' (by means of the bolt 515), if desired. FIG. 16 shows an opening in the shroud 505 to provide access to the head of the bolt 515, the snap button 511, and the hole 519 for the detent pin 590.

Figure 17:
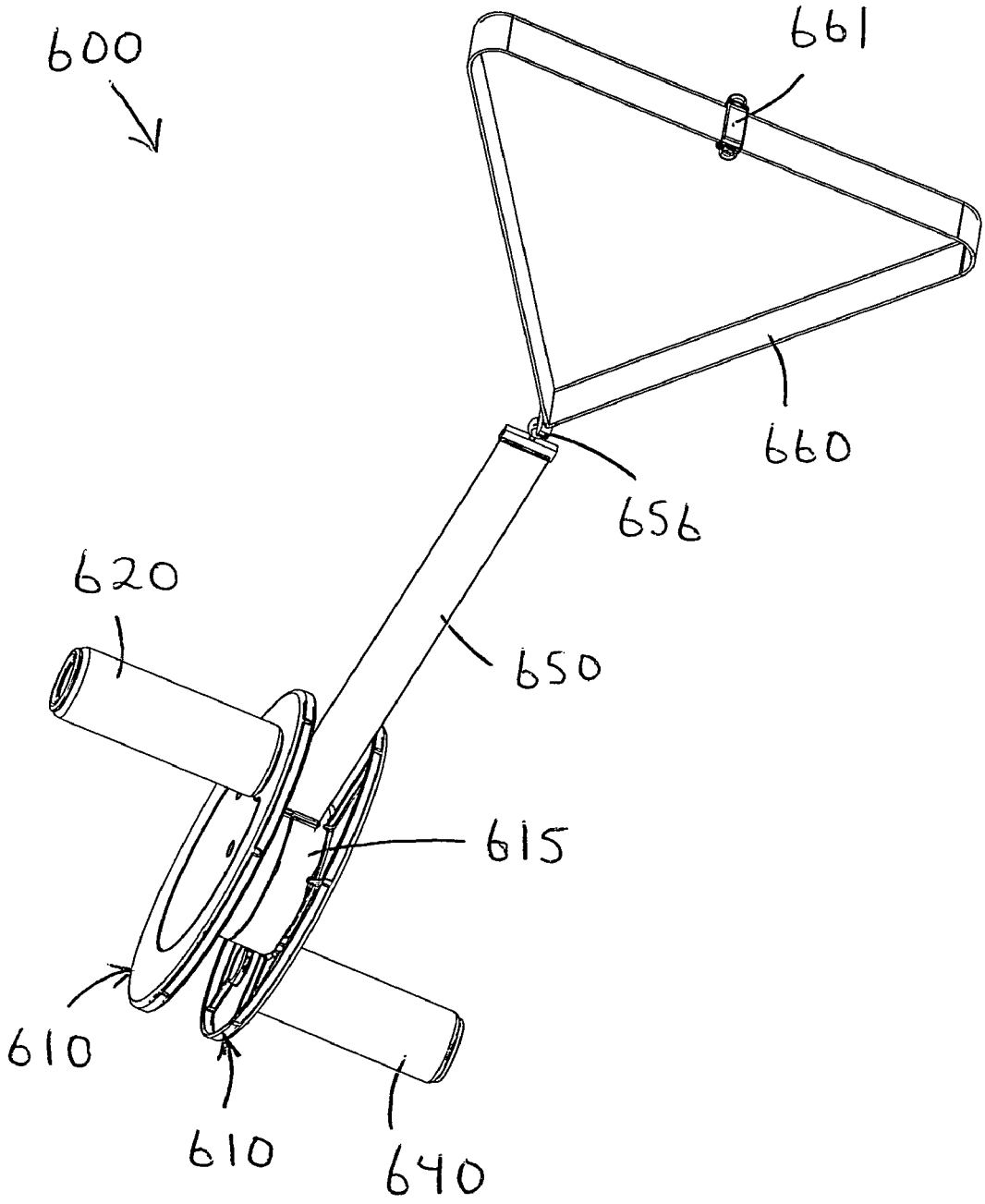
FIG. 17 is a perspective view of yet another exercise device constructed according to the principles of the present invention.
Figure 18:
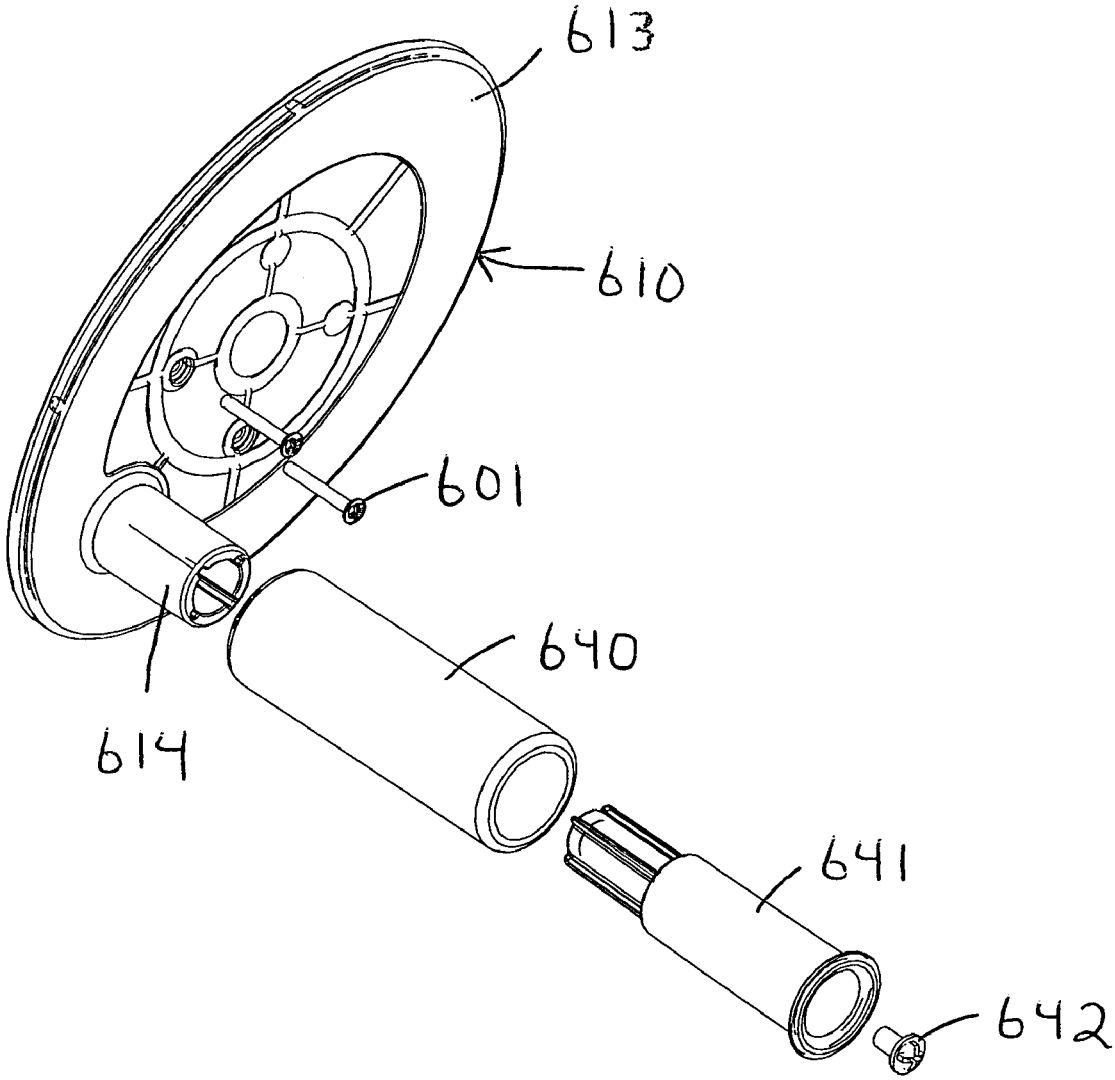
FIG. 18 is an exploded perspective view of components of the exercise device of FIG. 17.
Figure 19:
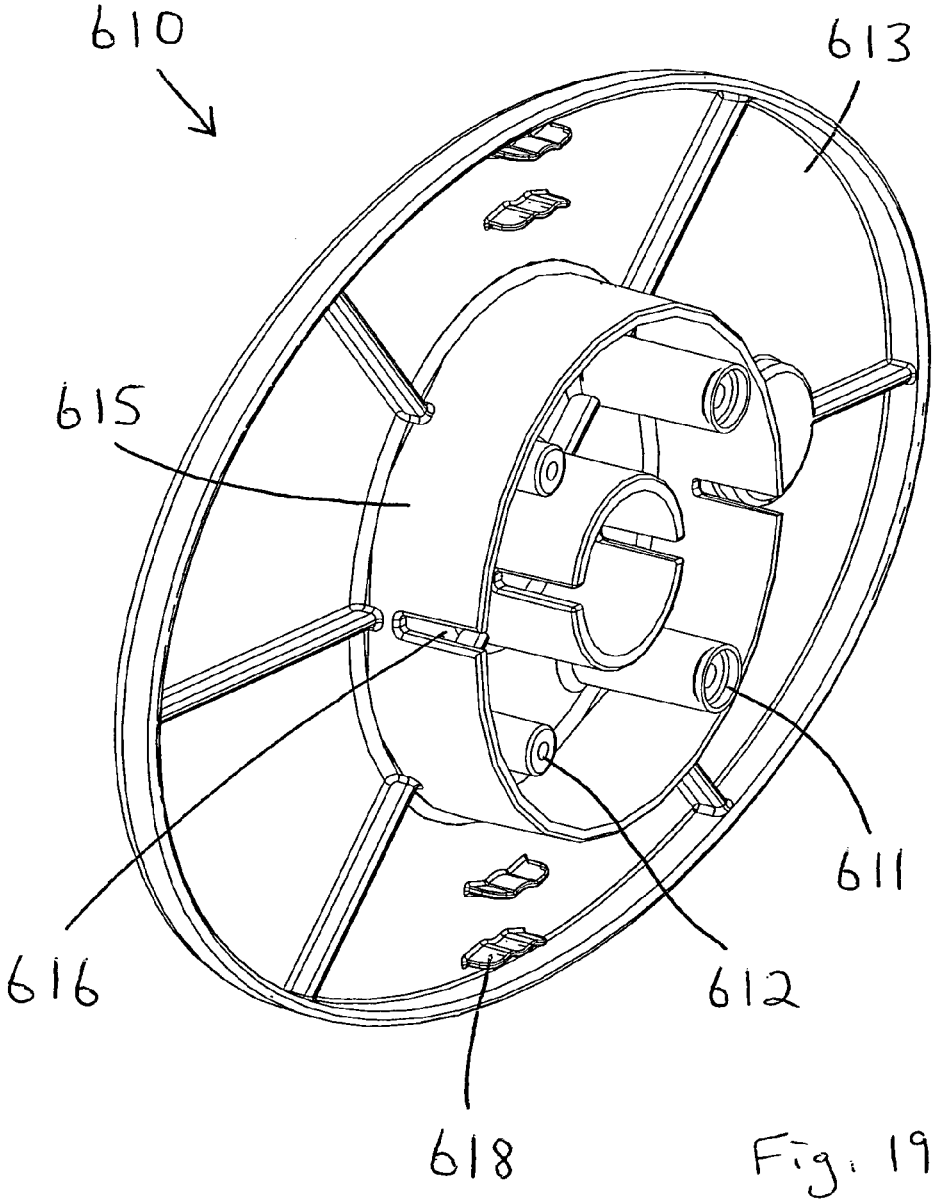
FIG. 19 is a perspective view of one of the components of FIG. 18.

FIGS. 17-19 show yet another embodiment 600 of the present invention. The device 600 includes left and right handles 620 and 640 that are interconnected for cooperative rotational movement about an axis (which extends parallel to the handles 620 and 640 and is centrally located therebetween, at an equal distance from each). The components interconnected between the handles 620 and 640 may be described as a support or frame portion of the device 600.

Each of the handles 620 and 640 may be described as a rigid tubular hand grip that is rotatably mounted on a respective frame member 610. With reference to the handle 640 shown in FIG. 18, for example, a tube 614 projects outward from a plate portion 613 of the frame member 610, and the tube 614 projects into the handle 640 (with enough space therebetween to accommodate rotation of the handle 640 about the tube 614). A peg 641 is inserted into an opposite, distal end of the handle 640 and into the outwardly projecting end of the tube 614. The peg 641 is configured to lock into the tube 614 and cooperate therewith to provide structural support for the handle 620. The peg 641 is also configured to accommodate rotation of the handle 620 and to limit axial travel of the handle 620 (when a screw 642 is inserted through a hole in the end of the peg 641 and threaded into a nut anchored in place within the frame member 610).

The left and right frame members 610 are secured to one another to link the handles 620 and 640 and to define a sheave or drum. As shown in FIG. 19, long posts 611 and short posts 612 project outward from the plate portion 613, in a direction opposite the tube 614. When the tubes 614 on the two frame members 610 are arranged in diametrically opposed locations, the long posts 611 on one frame member 610 align and interengage with the short posts 612 on the other frame member, and the short posts 612 on the one frame member 610 align and interengage with the long posts 611 on the other frame member 610. As shown in FIG. 18, screws 601 extend through the long posts 611 and are threaded into the short posts 612 to secure the two frame members 610 to one another.

FIG. 19 also shows a cylindrical hub 615 projecting outward from the plate portion 613, and forming a wall about the posts 611 and 612. Diametrically opposed slits 616 are provided in the wall of the hub 615 to accommodate attachment of strap segment 650 relative to the frame members 610. In this regard, an end of the strap segment 650 is overlapped onto itself and sewn (or otherwise thickened) to prevent movement through the slits 616, and this oversized end is then disposed inside the hubs 615 prior to installation of the screws 601 (with a proximate portion of the strap segment 650 extending through the slits 616).

An opposite distal end of the strap segment 650 is connected to a second strap segment 660 via a ball and socket fastener 656 (or other conventional fastener). The second strap segment 660 is formed into a closed loop, and a clip 661 is preferably captured on an intermediate portion thereof. The clip 661 is configured to snap into engagement with flanges 618 on the frame members 610 (see FIG. 19) when it is desirable to maintain the strap segments 650 and 660 completely wound about the hubs 615. The ball and socket fastener 656 accommodates movement of the strap segment 660 from a first orientation, aligned with the other strap segment 650 for winding about the hubs 615, and a second orientation, arranged to lie flat across a person's feet (see FIG. 17). In other words, the strap segments 650 and 660 may be alternatively "stowed" relative to the frame members 610 to accommodate certain exercises described above with reference to other embodiments, and/or deployed to accommodate other exercises described above with reference to other embodiments.

The present invention has been described with reference to specific devices and particular methods with the understanding that persons skilled in the art will recognize various other manners to practice the subject invention. Among other things, equivalent components and/or arrangements may be substituted for those disclosed herein without departing from the scope of the present invention. Moreover, the components and/or features described with reference to various embodiments may be mixed and matched to arrive at other embodiments. Furthermore, it is understood that various parts may be formed and/or interconnected in various suitable ways and/or from various suitable materials. In view of the foregoing, the scope of the invention is to be limited only to the extent of the claims that follow.

What is claimed is:

1. A method of performing an assisted abdominal exercise with a hand-held exercise device having a sheave that is rotatable about an axis, left and right handles connected to the sheave at diametrically opposed locations relative to the axis, and a flexible member having a first end portion secured to the sheave, and an opposite, second end portion releasably secured to one's left and right feet, comprising the steps of:

grasping the handles in one's respective left and right hands and lifting the sheave; and while holding the sheave in space with the flexible member extending directly from the sheave to an opposite, second end portion of the flexible member that is secured to one's left and right feet, rotating the sheave about the axis to wind the flexible member onto the sheave and pull one's upper torso and said one's feet toward one another.

2. The method of claim 1, wherein the rotating step is performed while lying on one's back, contracting one's abdominal muscles, and holding the sheave in space between one's knees and one's head.

3. The method of claim 1, wherein the rotating step is performed while lying on one's back, contracting one's abdominal muscles, and holding the sheave in space above one's torso.

4. The method of claim 1, wherein the rotating step pulls the second end portion of the flexible member directly toward the sheave over a distance equal to how much of the flexible member is wound onto the sheave during the rotating step.

5. The method of claim 1, further comprising the step of while continuing to hold the sheave in space with the flexible member extending directly between the sheave and said one's feet, rotating the sheave in an opposite direction about the axis to unwind the flexible member from the sheave and accommodate movement of one's upper torso and one's feet away from one another.

6. The method of claim 5, wherein the sheave is rotated in alternating first and second directions of rotation in synchronization with one's performing (a) a sit-up exercise during winding of the flexible member about the sheave and (b) a reclining movement during unwinding of the flexible member from the sheave.

7. The method of claim 5, further comprising the step of relaxing one's abdominal muscles to allow one's thighs and one's upper torso to move away from one another throughout rotation of the sheave in the opposite direction.

8. The method of claim 1, further comprising the step of exerting opposing axially directed forces through respective said handles during the rotating step.

9. The method of claim 1, further comprising the step of contracting one's abdominal muscles to help pull one's upper torso toward one's feet throughout performance of the rotating step.

10. A method of performing an assisted abdominal crunch exercise with an exercise device having diametrically opposed left and right handles that rotate about a common axis, comprising the steps of:

linking rotation of the handles about the axis to variation in a common angle defined between one's upper torso and one's left thigh and between one's upper torso and one's right thigh;

grasping the handles in one's respective hands and holding the device in space between one's head and one's knees; and while continuing to perform the holding step and while maintaining one's feet in a stationary position, pulling one's upper torso toward one's thighs by contemporaneously (a) rotating the handles in an angle reducing direction about the axis, and (b) contracting one's abdominal muscles.

11. The method of claim 10, further comprising the step of also contemporaneously exerting opposing axially directed forces through respective said handles.

12. The method of claim 10, further comprising the step of while continuing to perform the holding step, moving one's upper torso away from one's thighs by contemporaneously (a) allowing the handles to rotate in an opposite, angle enlarging direction about the axis and (b) relaxing one's abdominal muscles.

13. The method of claim 12, wherein the pulling step and the moving step are repeated in alternating fashion, resulting in performance of a set of abdominal crunch exercises.

14. The method of claim 12, further comprising the step of flipping the device one hundred and eighty degrees about a second axis that extends perpendicular to said axis, and switching one's hands relative to the handles, thereby reversing each said direction of rotation.

15. The method of claim 10, wherein the rotating step is performed while lying on one's back and holding the device in space above one's torso.

16. The method of claim 10, further comprising the steps of flipping the device one hundred and eighty degrees about a second axis that extends perpendicular to said axis, and switching one's hands relative to the handles, thereby reversing the angle reducing direction of rotation.

17. A method of performing assisted abdominal exercise with a hand-held device having a sheave that is rotatable about an axis, left and right handles connected to the sheave at diametrically opposed locations relative to the axis, and a flexible member having a first end portion secured to the sheave, comprising the steps of:

assuming a starting position relative to a support surface, with the flexible member extending directly from the sheave to an opposite, second end portion of the flexible member that is secured to one's left and right feet, and with one's back resting against the support surface;

grasping the handles in one's respective left and right hands and lifting the device; and while holding the device in space above the support surface, contracting one's abdominal muscles and rotating the sheave about the axis to wind the flexible member onto the sheave and decrease a common angle defined (a) between one's left thigh and one's upper torso and (b) between one's right thigh and one's upper torso.

18. A method of performing an assisted abdominal crunch exercise with a hand-held exercise device having a sheave that is rotatable about an axis, left and right handles connected to respective, opposite sides of the sheave, wherein at least one of the handles is connected to the sheave at a radially displaced location relative to the axis, and a flexible member having a first end portion anchored to the sheave, and an opposite, second end portion releasably anchored in a fixed position proximate one's left and right feet, comprising the steps of:

assuming an abdominal crunch position relative to a support surface;

grasping the handles in one's respective left and right hands and lifting the sheave; and while (a) holding the sheave in space with the flexible member extending directly between the sheave and the fixed position proximate one's left and right feet, and (b) holding one's left and right feet stationary, contracting one's abdominal muscles and rotating the sheave about the axis, thereby winding the flexible member onto the sheave to help pull one's upper torso toward one's feet.

* * * * *